US009644333B2

(12) United States Patent
Regenauer

(10) Patent No.: US 9,644,333 B2
(45) Date of Patent: May 9, 2017

(54) EROSION CONTROL SEDIMENT BARRIER

(71) Applicant: Urethane Technology Company, Inc., Newburgh, NY (US)

(72) Inventor: Volker Regenauer, Campbell Hall, NY (US)

(73) Assignee: Urethane Technology Company, Inc., New Burgh, NY (US)

( * ) Notice: Subject to any disclaimer, the term of this patent is extended or adjusted under 35 U.S.C. 154(b) by 0 days.

(21) Appl. No.: 14/477,983

(22) Filed: Sep. 5, 2014

(65) Prior Publication Data

US 2015/0071716 A1 Mar. 12, 2015

Related U.S. Application Data

(60) Provisional application No. 61/874,418, filed on Sep. 6, 2013, provisional application No. 61/912,299, filed on Dec. 5, 2013.

(51) Int. Cl.

| | |
|---|---|
| ***E02B 1/00*** | (2006.01) |
| ***E02B 3/12*** | (2006.01) |
| ***E02B 3/02*** | (2006.01) |

(52) U.S. Cl.

CPC ..... *E02B 3/02* (2013.01)

(58) Field of Classification Search

CPC ..... E02B 3/122
USPC ..... 405/302.6
See application file for complete search history.

(56) References Cited

U.S. PATENT DOCUMENTS 2,789,399 A * 4/1957 Finn ..... C09K 17/52 111/900
3,313,321 A 4/1967 Keller
4,717,283 A * 1/1988 Bach ..... E01C 3/00 404/17
5,100,258 A * 3/1992 VanWagoner ..... E02B 11/00 405/36
5,102,260 A * 4/1992 Horvath ..... E02D 31/10 405/284
5,185,383 A 2/1993 Regenauer
5,713,696 A * 2/1998 Horvath ..... E02D 31/02 264/321
5,765,967 A * 6/1998 Klaymar ..... E02F 5/226 37/142.5
5,900,195 A 5/1999 Pool et al.
6,296,924 B1 * 10/2001 Bach ..... E02D 17/202 405/15
6,641,335 B1 * 11/2003 Allard ..... B32B 1/08 405/15

(Continued)

FOREIGN PATENT DOCUMENTS

| | | |
|---|---|---|
| EP | 0 547 515 B1 | 3/1997 |
| EP | 0 567 027 B1 | 3/1997 |
| EP | 0 581 191 B1 | 5/1997 |

OTHER PUBLICATIONS

All-Foam Products Company, American-Made Open Cell Foams & Closed Cell Foams—http://www.allfoam.com/index.html—dated retrieved May 2, 2013.

*Primary Examiner* — Benjamin Fiorello
(74) *Attorney, Agent, or Firm* — Baker & Hostetler LLP

(57) ABSTRACT

An erosion control sediment barrier is disclosed. Specifically, erosion control sediment barriers are provided comprised of a filter component shaped to fit over a pipeline in a trench that is tacked or held in place through the use of an adhesive foam, such as urethane foam.

19 Claims, 5 Drawing Sheets

(56) References Cited

U.S. PATENT DOCUMENTS

| | | | | |
|---|---|---|---|---|
| 6,969,215 | B2 | 11/2005 | Duncan | |
| 7,029,201 | B1 * | 4/2006 | McCormick | E03F 1/002 405/36 |
| 7,186,059 | B2 | 3/2007 | Barnes | |
| 7,438,802 | B2 * | 10/2008 | Hurst | B01D 21/0006 210/163 |
| 7,857,547 | B1 * | 12/2010 | Summers | E03F 1/002 405/43 |
| 8,287,728 | B2 | 10/2012 | Kania et al. | |
| 8,454,270 | B1 | 6/2013 | Benaske | |
| 2002/0137871 | A1 * | 9/2002 | Wheeler, Jr. | B29C 44/06 528/44 |
| 2002/0155237 | A1 * | 10/2002 | Allard | B32B 1/08 428/36.1 |
| 2003/0012604 | A1 * | 1/2003 | Fukui | E02B 3/04 405/16 |
| 2003/0092531 | A1 * | 5/2003 | Daluise | A63C 19/04 482/1 |
| 2005/0042034 | A1 * | 2/2005 | Bose | E02F 5/223 405/129.57 |
| 2007/0215267 | A1 | 9/2007 | Brown | |
| 2009/0169311 | A1 * | 7/2009 | Sharley | E01B 1/001 405/302.6 |
| 2012/0315089 | A1 * | 12/2012 | Burns | E02D 31/002 405/16 |
| 2013/0216310 | A1 * | 8/2013 | Bass | B09B 1/004 405/80 |

* cited by examiner

EROSION CONTROL SEDIMENT BARRIER

CROSS-REFERENCE TO RELATED APPLICATIONS

This application is a continuation of and claims priority to U.S. Provisional Application No. 61/874,418, filed on Sep. 6, 2013 and U.S. Provisional Application No. 61/912,299, the entire contents of both which are hereby incorporated by reference.

TECHNICAL FIELD

The present disclosure relates to sediment barrier systems, and sediment barrier systems including liquid sediment filters and/or filtration systems therein.

BACKGROUND

Erosion control sediment barrier systems are used and needed in many different applications throughout the world every year. For example, many miles of pipelines are laid into excavations throughout the United States every year. The pipelines are utilized for carrying many varied materials, such as salt water, natural gas, crude oil, and the like. Many of these pipelines are laid on mountainous or highly graded terrain, some of which may be very remote.

In such circumstances, it has been found that drainage issues involving pipelines, particularly newly laid pipelines, can be problematic. Specifically, since water can easily permeate the soil in the trench created to lay a pipeline, even after backfilling, there have been issues in the past with this water flowing down highly graded areas, sometime causing minor washouts under and around the pipeline, sometimes washing out the pipeline altogether.

Accordingly, it has been found desirable to provide such installations with "trench breakers" that stop or retard the flow of water at certain intervals down the pipeline. Such trench breakers that have been used in the past include sand bags and closed cell foam. While these types of solutions have been helpful, they have also been problematic. Specifically, the use of sandbags is labor intensive and expensive given the weight thereof and the frequent remoteness of the areas where these applications are installed. Additionally, sand bags have very low water permeability. Thus, while the use of sand bags is helpful in stopping the water flow down the backfilled trench, the backup of water behind the bags can result in significant hydrostatic pressure build-up which can, at times, lead to failures in the sandbag trench breakers. Furthermore, the use of sandbags requires workers to enter the excavation site thereby requiring the use of expensive and time consuming safety measures during the installation process to protect the safety of the workers.

Additionally, while the use of closed cell foams (such as urethane foams), has alleviated some of the cost and labor intensive installation issues, they have been relatively ineffective in resolving the issues caused by hydrostatic buildup behind trench breakers installed as such due to the fact that closed cell foam (as opposed to open cell foam) is almost entirely water impermerable.

Other examples of applications and/or situations in which it would be desirable to have an erosion control sediment barrier system include pavement installations, blanket drains, base courses, drains for structures such as retaining walls, bridge abutments, wraps for well pumps, interceptor toe drains, surface drains, chimney drains for damns, etc. More specifically, erosion control sediment barrier systems are desired in applications where it is desired to stop or limit sediment, soil and/or mass water flow while not preventing controlled water flow therethrough.

Accordingly, it would be desirable to have an erosion control sediment barrier system for use in the above-identified applications that is relatively light, inexpensive and non-labor intensive to install, and which resolves some issues created by the hydrostatic pressure build-up behind the barrier system found when using prior art erosion control sediment barriers.

SUMMARY

Thus, what is disclosed herein is an erosion control sediment barrier system comprised of a filter material that may be located in a frame member which may then be secured in a desired location. Additionally, in accordance with the disclosure the erosion control sediment barrier system enables the users thereof to easily and efficiently tailor the filtration efficiency, size of the assembly and physical properties of the frame to achieve a desired sediment control.

DETAILED DESCRIPTION

Figure 1:
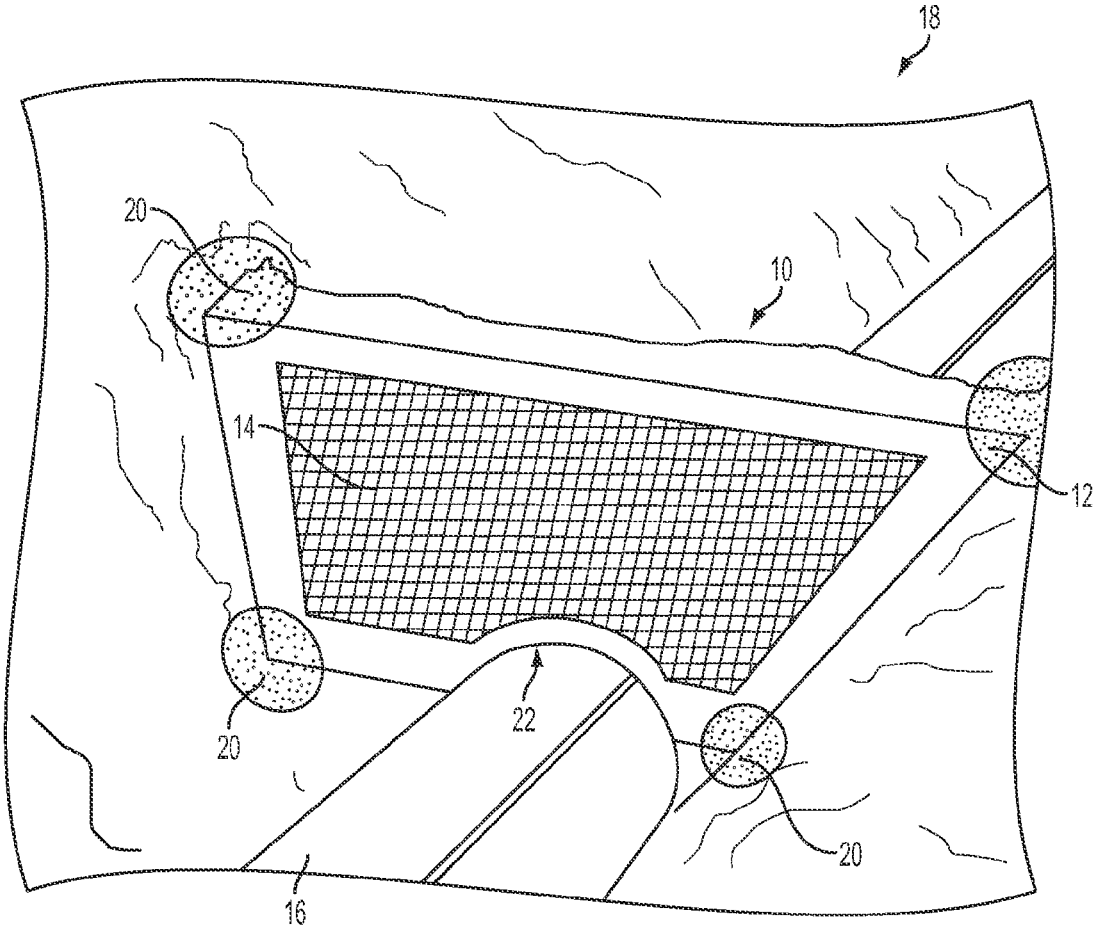
FIG. 1 is a front perspective view of an erosion control sediment barrier in accordance with an aspect of the present disclosure.

Turning now to the disclosure and a detailed description of the drawings, attention is directed to FIG. 1, which is a front perspective view of an erosion control sediment barrier 10 in accordance with an aspect of the present disclosure. In this embodiment, the erosion control sediment barrier 10 includes a filter component 14 comprised of at least one filter material 34 and a frame 12. In the embodiment depicted in FIG. 1, the erosion control sediment barrier 10 is acting as a trench breaker and is shaped to fit over a pipeline 16 in a trench 18. In this aspect, the erosion control sediment barrier 10 maybe tacked into place using a foaming adhesive 20, such as an open or closed cell urethane. In this embodiment, the erosion control sediment barrier 10 includes a notch 22 therein for receiving a length of pipeline 16 therethrough.

Figure 2:
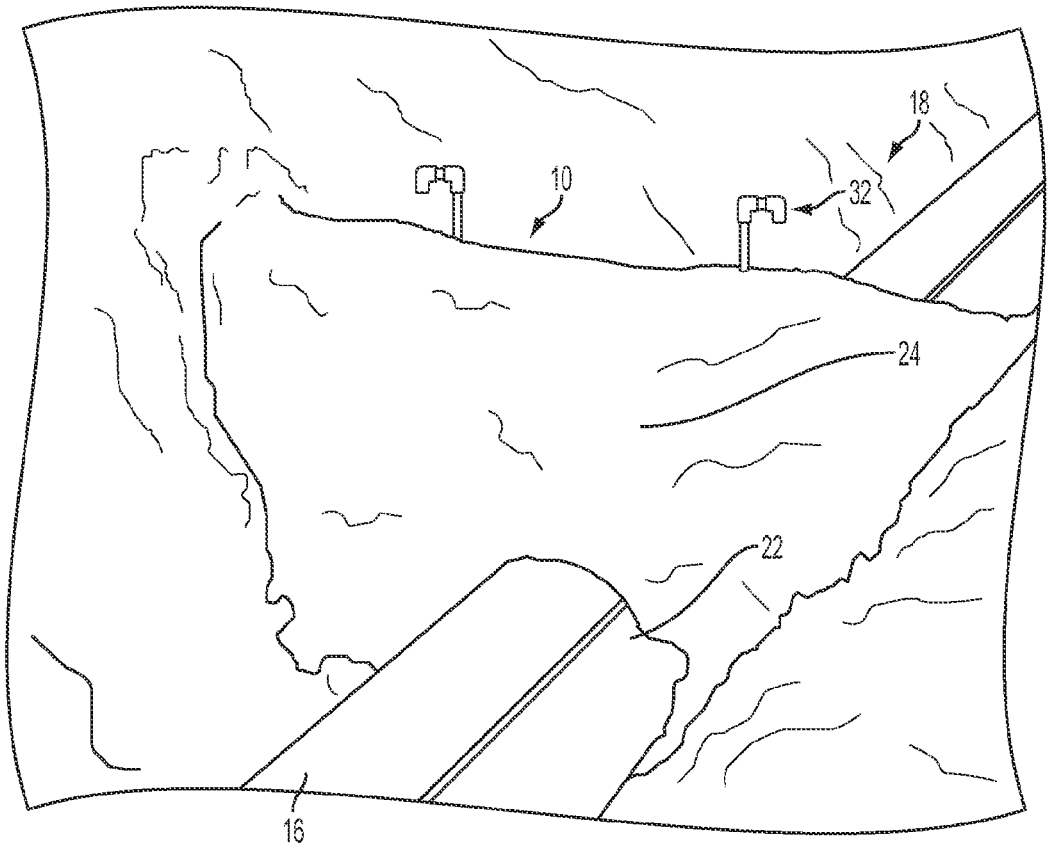
FIG. 2 is a front perspective view of an alternate embodiment of an erosion control sediment barrier in accordance with an aspect of the disclosure.

FIG. 2 depicts an embodiment of an erosion control sediment barrier 10 in accordance with the present disclosure wherein the filter component 14 is covered over with an at least semi-permeable coating 24, such as an open cell urethane coating.

Figure 3:
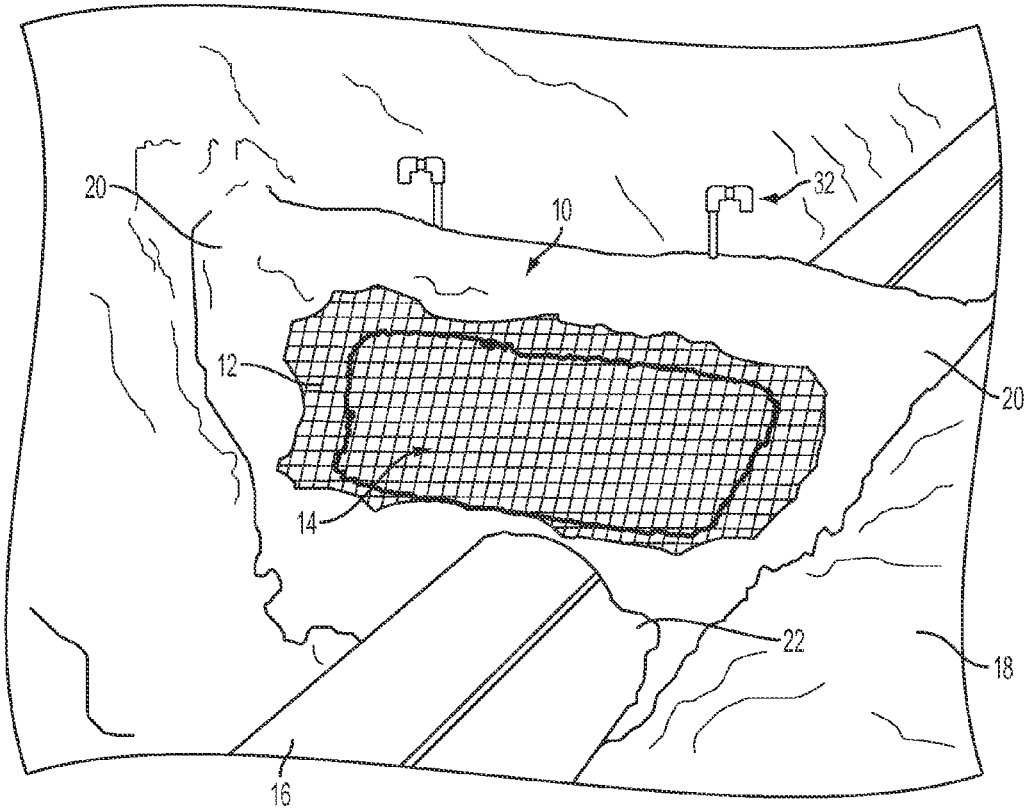
FIG. 3 is a front perspective view of an alternate embodiment of an erosion control sediment barrier in accordance with an aspect of the disclosure.

FIG. 3 depicts an embodiment of an erosion control sediment barrier 10 in accordance with the present disclosure wherein the filter component 14 is partially covered over with a foaming adhesive 20 leaving at least a portion of the filter component 14 uncovered.

Figure 4:
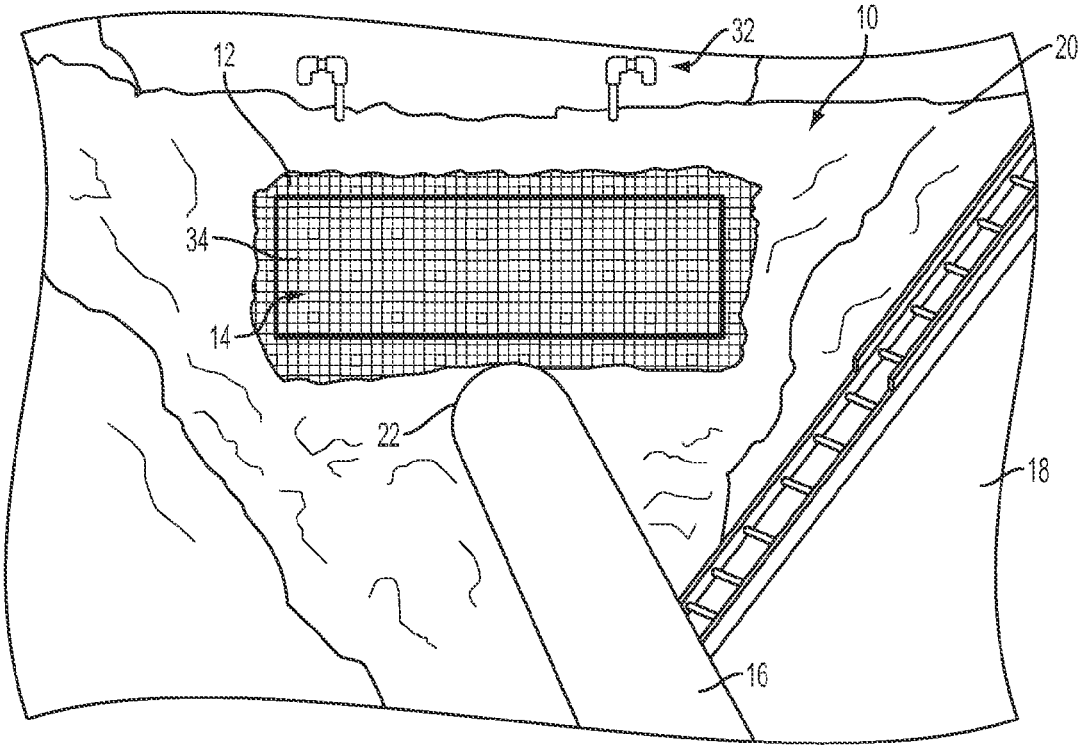
FIG. 4 is a front perspective view of an alternate embodiment of the erosion control sediment barrier shown in FIG. 3.

FIG. 4 depicts an embodiment of an erosion control sediment barrier 10 in accordance with the present disclosure wherein the filter component 14 includes perforated collection tubes 28 (shown in FIG. 5) therein and having an emergency outfall 32 that extends upward and outwardly of the filter component 14 of the sediment barrier 10.

Figure 5:
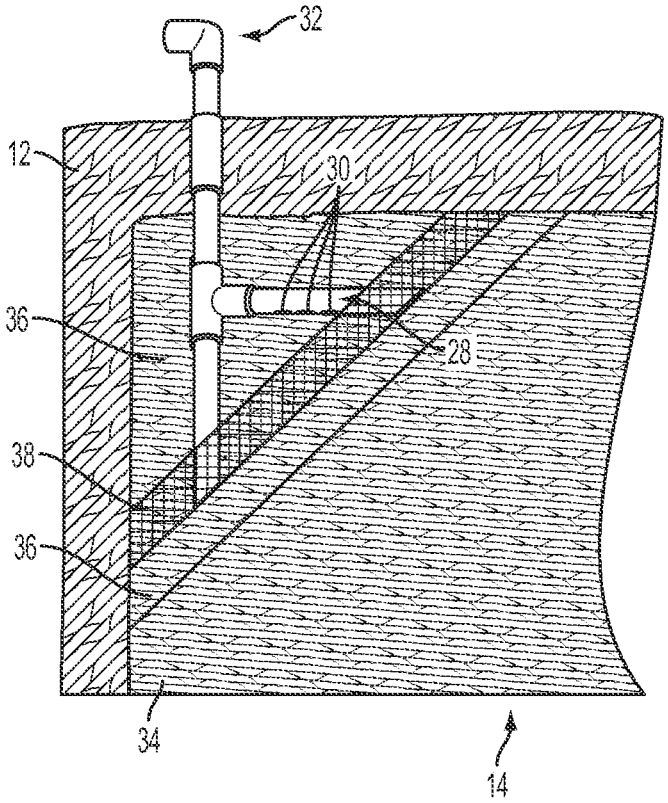
FIG. 5 is a front cutaway view of a portion of a filter component suitable for use in connection with an erosion control sediment barrier in accordance with aspects of the present disclosure.

FIG. 5 depicts a front cutaway view of a portion of a filter component 14 suitable for use in connection with an erosion control sediment barrier 10 in accordance with an aspect of the present disclosure. Specifically, in one embodiment of the disclosure, the filter component 14 may comprise a sandwich structure to further aid in desired filtration. Specifically, underneath the first filter material 34 may be a second filter material 36 which may have desired filtering characteristics different from those of the first filter material 34. Next a structural mesh 38 which may be a honeycomb structure, and optionally made of a metal mesh material, such as chicken wire, may be disposed between an optional additional layer of second (or first) filter material 36. The first and second filter materials 34, 36 may be of any desired and operable structure and may comprise a natural and/or man-made fibrous mat.

As discussed above, the filter component 14 may include a perforated collection tube 28 incorporated therein. The perforated collection tube 28 includes holes 30 therein and an emergency outfall 32 that extends upward and outwardly of the filter component 14 of the sediment barrier 10. The perforated collection tube 28, as it is formed inside the filter component 14, may comprise a loop and may be of any desired geometry, such as a square (as partially shown in FIG. 5), or a circle, triangle, etc., as would be understood by a person of ordinary skill in the art, such that in a liquid overflow (i.e. emergency) situation, liquid is collected and allowed to exit the erosion sediment barrier 10 through the emergency outfalls 32.

In accordance with applications of the present disclosure, exemplary filter materials that may be used in accordance herewith include geotextile US fabrics/US200NW manufactured by, for example, Tencate/Mirafi and Hanes Geo-Composites/terratex. They may be purchased or used in accordance with the disclosure in a pre-framed format or may be framed as desired for use in accordance herewith.

In accordance with the disclosure, any geotextile mat may be used as a filter material as cost constraints and/or desired material characteristics (such as permeability, weight, structurally rigidity, etc.) are considered. Consistent herewith, filter material may be comprised of mats of suitable fabric or other materials of minimal thickness (under for example, 2 inches) and may or may not exhibit any structural strength depending on the application and desired permeability/cost/other constraints. In accordance with the disclosure, a rigid frame 12 may is provided for the filter material 34, 36. The frame 12 is preferably shaped and sized so that the entire structure may be dropped into excavations and affixed in place with an adhesive 20 such a, for example, closed and/or opened cell urethane foam. In accordance with embodiments of the disclosure, the frame 12 is preferably formed from materials specified to carry a compressive load at least equal to the surrounding soil once the excavation is back-filled.

In another aspect of the disclosure, the filter materials 34, 36 may be comprised of a composite product composed of natural and/or man-made fibrous mats (such as a matrix) and/or geotextile fabrics that are layered according to the filtration requirements as dictated by soil conditions and hydraulic pressures. In accordance with the disclosure, these products may be joined with another material, such as a polyurethane material, that can be varied and/or tailored to provide desired permeability, structural integrity and/or impermeability characteristics. In accordance with the disclosure, the composite disclosed herein, once framed, may be shaped to fit the specific requirements of the site and use.

In yet another aspect of the disclosure, the filter material may be comprised of layers of mat fibrous materials, geotextile fabrics, and other filter materials that are cut, stacked, and shaped according to the requirements of the specific application. In accordance with this aspect, these layers may then be adhered to each other by the use of an adhesive, such as an injection polyurethane, into the composite layers. In accordance therewith, the adhesive may flows into, thru and between the various layers, thereby gluing them together.

It is noted that in accordance with the disclosure, as discussed above, the erosion control sediment barrier 10 characteristics may be adjusted to suit the expected hydraulic flow and pressures. For example, by increasing the surface area of the filter component 14, overall mass of the composite used as the filter materials, and/or the pore sizes of the filter material, it is possible to control the flow of water and/or size of sediment retained by the composite/allowed to flow through the composite.

An erosion control sediment barrier 10 in accordance with the disclosure may be manufactured in any specific manner. Exemplary materials that may be used include, but are not limited to a filter component 14 made from any fibrous pre-form that is woven, braided, stitched, knitted or otherwise formed. Further, as discussed above, fabrics, including geotextile fabric may be used as desired depending on the application. Exemplary adhesives that may be used include, but are not limited to closed cell polyurethanes, open cell polyurethanes, or a combination of the two. Also operable for use are rigid, flexible, solid elastomer, polyesters and the like.

One exemplary method of manufacture of a filter component 14 for use in an erosion control sediment barrier 10 in accordance with the disclosure would include taking fibrous mat material and/or fabric, cutting the same, and stacking it in a jig. Next, binder material may then be injected into and thru the mat and/or fabric material to bind, seal and create a finished material. The finished material may then be framed in a rigid material, or, if desired, used as a single preformed piece (assuming a frame is not necessary).

In accordance with the disclosure, the filter materials 34, 36 of the filter component may be selected or adjusted to suit soil conditions and the levels of filtration required. For example, a filter component 14 consisting almost entirely of fibrous mats may tend to be very porous and to allow water to flow freely. While this may be desirable in some applications, other applications may require less water permeability. For example, in poorly graded, uniformly graded or gap graded soils, it may be desired to incorporate layers of fabric in the filter component 14 to tailor particulate permeability as the circumstances may require.

It should be noted that the thickness of the filter materials 34, 36 used in the filter component 14 may be adjusted based upon desired characteristics as discussed above. For example, it is considered within the scope of the disclosure that the filter component may 14 be adjusted from thicknesses of less than an inch to greater than 3 feet if desired. This adjustability allows the erosion control sediment barrier 10 of the present disclosure to be adjusted based upon the desired overall filtration/flow potential, through use of factors such as surface area and soil retention properties.

Similarly, the frame 12 material can be adjusted in order that the filter component/matrix is either rigid and structural, or flexible and compressive. The frame 12 binder can also be permeable or impermeable.

One example of the potential use of an erosion control sediment barrier 10 of the present disclosure includes placing the same in an excavation trench 18 over the pipe, electric line or utility as a trench breaker. Consistent therewith, polyurethane (or other binder) may be sprayed or poured over to seal and/or affix the barrier 10 to the utility line, pipe, and walls of the excavated trench 18. This is done in order to force the flow of water thru the filter component 14, not over around or under the pipe, utility etc.

In other embodiments of the disclosure, a perforated outer structural skin may be added over the filter component 14. In such embodiments, the perforated outer structural skin may be made of structural plastic, metal, grapheme, or other similar materials.

Following from the above description it should be apparent to those of ordinary skill in the art that, while the systems, methods and apparatuses herein described constitute exemplary embodiments of the present disclosure, it is understood that the disclosure is not limited to these precise systems, methods and apparatuses and that changes may be made therein without departing from the scope of the disclosure.

What is claimed is:

1. An erosion control sediment barrier comprising:

a filter component shaped and sized to fit over a pipeline in a trench;

an adhesive for keeping the filter component fixed in the trench; wherein the filter component is comprised of a filter material fixed in a frame and wherein the filter component includes a notch therein for receiving a length of pipeline therethrough.

2. The erosion control sediment barrier of claim 1 wherein the filter component includes at least one structural mesh therein.

3. The erosion control sediment barrier of claim 2 wherein the filter component includes at least one perforated tube incorporated therein.

4. The erosion control sediment barrier of claim 2 wherein the structural mesh is configured in a honeycomb structure.

5. The erosion control sediment barrier of claim 1 wherein the filter component comprises at least two different filter materials combined in a sandwich configuration.

6. The erosion control sediment barrier of claim 1 wherein the filter component is at least partially covered in an open cell foam.

7. The erosion control sediment barrier of claim 6 wherein the open cell foam is urethane open cell foam.

8. An erosion control sediment barrier comprising:

a filter component shaped and sized to fit over a pipeline in a trench;

an adhesive for keeping the filter component fixed in the trench; wherein the filter component is comprised of a filter material fixed in a frame including at least one structural mesh and at least one perforated tube therein and further comprising emergency outfalls extending outside of the filter component fluidicly connected to the perforated tube.

9. A method for controlling erosion in a pipeline trench comprising the steps of:

selecting a filter component shaped and sized to fit over a pipeline in a trench; and tacking the filter component to the sides of the trench with an adhesive; wherein the step of selecting a filter component includes the step of selecting a filter component comprising a filter material fixed in a frame having at least one perforated tube incorporated therein and including emergency outfalls extending outside the filter component fluidicly connected to the perforated tube;; and thereafter backfilling the trench.

10. The method of claim 9 wherein the step of selecting the filter component further includes the step of selecting a filter component including at least two different filter materials combined in a sandwich configuration.

11. The method of claim 9 further comprising the step of at least partially covering the filter component with an open cell foam.

12. The method of claim 9 further comprising the step of at least partially covering the filter component with an open cell urethane foam.

13. An erosion control sediment barrier comprising:

a filter component comprised of a frame having a filter material therein, the frame having a notch therein shaped to receive a portion of a pipeline therethrough;

a urethane adhesive attaching the filter component to the sides of a pipeline trench.

14. A method for controlling erosion in a pipeline trench comprising the steps of: selecting a filter component shaped and sized to fit over a pipeline in a trench in a substrate wherein the pipeline is laid generally parallel to a surface of the substrate and runs in a direction with respect thereto; securing the filter component generally perpendicularly over the pipeline in an orientation normal to the direction in which the pipeline runs, wherein the step of securing the filter component over the pipeline includes using a urethane adhesive to attach the filter component to the side of the pipeline trench.

15. The method of claim 14 wherein the step of selecting a filter component includes the step of selecting a filter component comprising a filter material fixed in a frame.

16. The method of claim 14 further comprising the step of backfilling the trench.

17. The method of claim 14 wherein the step of securing the filter component over the pipeline includes using a urethane adhesive to attach the filter component to the sides of the pipeline trench.

18. The method of claim 14 wherein the step of selecting the filter component further includes the step of selecting a filter component having a notch therein shaped to receive a portion of the pipeline therethrough.

19. The method of claim 14 further comprising the step of at least partially covering the filter component with an open cell foam.

* * * * *